US008046235B2

(12) United States Patent
Kim et al.

(10) Patent No.: US 8,046,235 B2
(45) Date of Patent: Oct. 25, 2011

(54) APPARATUS AND METHOD OF ENCODING AUDIO DATA AND APPARATUS AND METHOD OF DECODING ENCODED AUDIO DATA

(75) Inventors: Miyoung Kim, Suwon-si (KR); Sangwook Kim, Seoul (KR); Dohyung Kim, Hwaseong-si (KR); Shihwa Lee, Seoul (KR); Junghoe Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/923,171

(22) Filed: Sep. 7, 2010

(65) Prior Publication Data

US 2010/0332239 A1 Dec. 30, 2010

Related U.S. Application Data

(62) Division of application No. 11/403,827, filed on Apr. 14, 2006, now Pat. No. 7,813,932.

(60) Provisional application No. 60/671,111, filed on Apr. 14, 2005, provisional application No. 60/706,441, filed on Aug. 9, 2005, provisional application No. 60/707,546, filed on Aug. 12, 2005.

(30) Foreign Application Priority Data

Dec. 30, 2005 (KR) ..... 10-2005-0135837

(51) Int. Cl.
*G10L 19/00* (2006.01)

(52) U.S. Cl. ..... 704/500; 704/E19.044; 704/E21.011

(58) Field of Classification Search ..... 704/500, 704/E19.044, E21.011
See application file for complete search history.

(56) References Cited

U.S. PATENT DOCUMENTS

| | | | | |
|---|---|---|---|---|
| 5,812,971 | A | 9/1998 | Herre | |
| 6,349,284 | B1 | 2/2002 | Park et al. | |
| 6,470,034 | B1 * | 10/2002 | Tan | 370/514 |
| 6,504,496 | B1 | 1/2003 | Mesarovic et al. | |
| 6,529,604 | B1 | 3/2003 | Part et al. | |

(Continued)

FOREIGN PATENT DOCUMENTS

EP 0869620 A2 10/1998

(Continued)

OTHER PUBLICATIONS

"ISO/IEC 14496-3:2001/FDAM1, Bandwidth Extension" Mar. 2003.*

(Continued)

*Primary Examiner* — Vijay Chawan
*Assistant Examiner* — Greg Borsetti
(74) *Attorney, Agent, or Firm* — Staas & Halsey LLP

(57) ABSTRACT

An apparatus and method encode audio data, and an apparatus and method decode encoded audio data. An audio data encoding apparatus includes: a scalable encoding unit dividing audio data into a plurality of layers, representing the audio data in predetermined numbers of bits in each of the plurality of layers, and encoding a lower layer prior to encoding an upper layer and an upper bit of each layer prior to encoding a lower bit of each layer; an SBR encoding unit generating spectral band replication (SBR) data that has information with respect to audio data in a frequency band of frequencies equal to or greater than a predetermined frequency among the audio data to be encoded, and encoding the SBR data; and a bitstream production unit generating a bitstream using the encoded SBR data and the encoded audio data corresponding to a predetermined bitrate.

2 Claims, 17 Drawing Sheets

U.S. PATENT DOCUMENTS

| | | | | |
|---|---|---|---|---|
| 7,110,941 | B2 | 9/2006 | Li | |
| 7,200,561 | B2 | 4/2007 | Moriya et al. | |
| 7,275,036 | B2 | 9/2007 | Geiger et al. | |
| 7,330,812 | B2 * | 2/2008 | Ding | 704/200.1 |
| 7,343,287 | B2 | 3/2008 | Geiger et al. | |
| 7,613,306 | B2 | 11/2009 | Miyasaka et al. | |
| 2004/0078205 | A1 | 4/2004 | Liljeryd et al. | |
| 2004/0174911 | A1 | 9/2004 | Kim et al. | |
| 2006/0015332 | A1 | 1/2006 | Chen et al. | |
| 2006/0200709 | A1 | 9/2006 | Yu et al. | |

FOREIGN PATENT DOCUMENTS

| | | |
|---|---|---|
| JP | 2004-272260 | 9/2004 |
| JP | 2006-520487 | 9/2006 |
| KR | 10-0261253 | 4/2000 |
| KR | 10-2004-0079558 | 9/2004 |
| KR | 10-2004-0086879 | 10/2004 |
| WO | WO2004/081918 A1 | 9/2004 |

OTHER PUBLICATIONS

"ISO/IEC 13818-7 Information technology—Generic coding of moving pictures and associated audio information—Part 7: Advanced Audio Coding (AAC)" Oct. 15, 2004.*

Japanese Office Action for corresponding Japanese Patent Application No. 2006-112402 dated Oct. 26, 2010 (2 pgs).

Korean Office Action for corresponding Korean Patent Application No. 10-2007-0054024 dated May 3, 2011, 4 pgs.

Yu et al., "A Scalable Lossy to Lossless Audio Coder for MPEG-4 Lossless Audio Coding" 2004.

Adistambha et al., "An Investigation into Embedded Audio Coding Using an AAC Perceptually Lossless Base Layer" 2004.

Raad et al., "Scalable to Lossless Audio Compression Based on Perceptual Set Partitioning in Hierarchical Trees (PSPIHT)" 2003.

Gril., "A Bite Rate Scalable Perceptual Coder for MPEG-4 Audio" 1997.

Kim et al., "Fine grain scalability in MPEG-4 Audio" 2001.

Geiger et al., "Fine Grain Scalable Perceptual and Lossless Audio Coding Based on INTMDCT" 2003.

Feiten et al., "Dynamically Scalable Audio Internet Transmission" 1998.

Wolters et al., "A closer look into MPEG-4 High Efficiency AAC" 2003.

Erne et al., "Perceptual Audio Coders "What to listen for"" 2001.

Matthew et al., "Modified MP3 Encoder Using Complex Modified Discrete Cosine Transform" 2003.

Park et al., "Multi-Layer Bit-Sliced Bit-Rate Scalable Audio Coding" 1997.

Myburg., "Design of a Scalable Parametric Audio Coder" 2004.

ISO/IEC FCD 14496-3 Subpart 4:1998(E).

Dunn., "Efficient Audio Coding with Fine-Grain Scalability" AES Sep. 21-24, 2001.

R. Geiger, J. Herre, G. Schuller, and T. Sporer, "Fine grain scalable perceptual and lossless audio coding based on INTMDCT", in Proc. ICASSP, 2003, pp. 445-448.

R. Yu, X. Lin, S. Rahardja, C. C. Ko., "A Scalable lossy to lossless audio coder for MPEG-4 Lossless audio coding," Proc. ICASSP, 2004.

Ehret et al., "State-of-the-Art Audio Coding for Broadcasting and Mobile Applications" AES Mar. 22-25, 2003.

D. Frerichs, "New MPEG-4 High-efficiency AAC Audio: Enabling New Application", Coding Technologies, available online, 2003.

E. Schuijers, J. Breebaart, H. Purnhagen, J. Engdegård: "Low complexity parametric stereo coding", Proc. 116$^{th}$ AES convention, Berlin, Germany, 2004, Preprint 6073.

Rongshan Yu, Ralf Geiger, Susanto Rahardja, Juergen Herre, Xiao Lin, Haibin Huang, "Mpeg-4 Scalable to lossless audio coding," 117$^{th}$ AES Convention Preprint 6183, 2004.

R. Yu, S. Rahardja, X. Lin, and C. C. Koh, "Improving coding efficiency for mpeg-4 audio scalable lossless coding," Proc, ICASSP, vol. 3, pp. 169-172, Mar. 2005.

ISO/IEC 144496-3 Standard, 2001.

Chiang, Wei-Hwa; Hwang, Chingtsung; Hsu, Yenkun. "Advances in Low Bit-Rate Audio Coding: A Digest of Selected Papers from Recent AES Conventions" JAES vol. 51 Issue 10 pp. 956-964; Oct. 2003.

Wolters et al., XP008063876, "A closer look into MPEG-4 High Efficiency AAC", Audio Engineering Society Convention Paper, New York, NY, Oct. 10-13, 2003.

Ehret et al., "Audio Coding Technology of ExAC", Proceedings of 2004 International Symposium on Intelligent Multimedia, Video and Speech Processing, Hong Kong, Oct. 20-22, 2004.

Herre et al., "Overview of MPEG-4 Audio and its Application Mobile Communications", Audio Department, Fraunhofer Institute for Integrated Circuits (IIS), Erlangen, Germany, 2000.

Park et al., XP009016481 "Multi-Layer bit-Sliced Bit-Rate Scalable Audio Coding", Samsung Advanced Institute of Technology, Korea, 1997.

Doliwa, Peter, 2004: 'MPEG-4 Advanced Audio Coding'.

M. Dietx, L. Liljeryd, K. Kjorling and O. Kunz, "Spectral Band Republication, a novel approach in audio coding", Preprint 5553, 112$^{th}$ AES Convention, Munich (D), May 10-13, 2002.

R. Koenen, Overview of the MPEG-4 standard, Mar. 2002, ISO/IEC JTC1/SC29/WG11 N1730.

U.S. Appl. No. 11/403,827, filed Apr. 14, 2006, Miyoung Kim et al., Samsung Electronics Co., Ltd.

Notice of Allowance dated Jun. 7, 2010 for related U.S. Appl. No. 11/403,827.

Office Action dated Feb. 22, 2010 for related U.S. Appl. No. 11/403,827.

Final Office Action dated Oct. 23, 2009 for related U.S. Appl. No. 11/403,827.

Office Action dated Apr. 17, 2009 for related U.S. Appl. No. 11/403,827.

European Search Report for European Patent Application No. EP06252067 dated Nov. 28, 2006.

Korean Patent Office Action mailed Feb. 1, 2007, and issued in corresponding Korean Patent Application No. 10-2006-0033208.

* cited by examiner

FIG. 6

| Syntax | No.of bits | Mnemonic |
|---|---|---|
| bsac_raw_data_block() | | |
| { | | |
| 610 bsac_base_element(); | | |
| layer=slayer_size; | | |
| while(data_available() && | | |
| layer<(top_layer+slayer_size)) { | | |
| bsac_layer_element(layer); | | |
| layer++; | | |
| } | | |
| byte_alignment(); | | |
| if (data_available()) { | | |
| 630 zero_code | 32 | bslbf |
| extension_type | 8 | bslbf |
| 640 while( data_available() ) { | | |
| switch(extension_type) { | | |
| 650 case EXT_BSAC_CHANNEL: | | |
| 620 extended_bsac_raw_data_block(); | | |
| case EXT_BSAC_SBR_DATA: 660 | | |
| extended_bsac_sbr_data(nch, 0); | | |
| case EXT_BSAC_SBR_DATA_CRC: 670 | | |
| extended_bsac_sbr_data(nch, 1); | | |
| }}} | | |

FIG. 7

| Syntax | No.of bits | Mnemonic |
|---|---|---|
| extended_bsac_sbr_data(nch, crc_flag) | | |
| { | | |
| num_sbr_bits = 0; | | |
| cnt = count; | 4 | uimsbf |
| num_sbr_bits += 4; | | |
| if (cnt == 15) { | | |
| cnt += esc_count - 1; | 8 | uimsbf |
| num_sbr_bits += 8; | | |
| } | | |
| if (crc_flag) { | | |
| bs_sbr_crc_bits; | 10 | uimsbf |
| num_sbr_bits += 10; | | |
| } | | |
| num_sbr_bits += 1; | | |
| if (bs_header_flag) | 1 | uimsbf |
| num_sbr_bits += sbr_header(); 710 | | |
| num_sbr_bits += bsac_sbr_data(nch, bs_amp_res); | | |
| num_align_bits = (8*cnt - num_sbr_bits)%8; | | |
| bs_fill_bits; | num_align_bits | uimsbf |
| return ((num_sbr_bits + num_align_bits ) / 8) | | |
| } | | |

APPARATUS AND METHOD OF ENCODING AUDIO DATA AND APPARATUS AND METHOD OF DECODING ENCODED AUDIO DATA

CROSS-REFERENCE TO RELATED APPLICATIONS

This application claims the benefit of U.S. Provisional Patent Application Nos. 60/671,111, 60/706,441, and 60/707,546 filed on Apr. 14, 2005, Aug. 9, 2005, and Aug. 12, 2005 in the U.S. Patent and Trademark Office, and Korean Patent Application No. 10-2005-0135837, filed on Dec. 30, 2005, in the Korean Intellectual Property Office, the disclosures of which are incorporated herein in their entireties by reference. This application is a divisional application of U.S. Ser. No. 11/403,827 filed Apr. 14, 2006, now U.S. Pat. No. 7,813,932 now allowed and incorporated by reference herein.

BACKGROUND OF THE INVENTION

1. Field of the Invention

The present invention relates to the processing of audio data, and more particularly, to an apparatus and method of encoding audio data and an apparatus and method of decoding encoded audio data, in which the bitrate of encoded audio data may be adjusted, and even when the audio data included in a bitstream to be decoded is encoded audio data of some of the layers of the encoded audio data, the audio data of all of the layers may be recovered.

2. Description of the Related Art

Bit sliced arithmetic coding (BSAC), which has been proposed by the applicant of the present invention, is a coding technique providing FGS (Fine Grain Scalability). In addition, BSAC is an audio compressing technique adopted as a standard by a moving picture experts group (MPEG)-4. BSAC is detailed in Korean Patent Publication No. 261253. Unlike BSAC, the advanced audio coding (MC) technique does not provide FGS.

When an encoder that uses the AAC encodes audio data, it can encode only audio data in some of the frequency bands of the audio data and transmit the encoded audio data to a decoder.

In this case, a spectral band replication (SBR) technique may be considered to recover the audio data in all frequency bands from the audio data in only certain encoded frequency bands that have been encoded using the ACC. In other words, the encoder that uses the AAC generates and encodes SBR data having information about audio data in frequency bands other than the certain encoded frequency bands and transmits the SBR data to the decoder together with the encoded audio data in the certain encoded frequency bands. The decoder can recover the original audio data by inferring the audio data in the frequency bands other than the certain encoded frequency bands. As such, the AAC and SBR techniques can be combined together.

Meanwhile, when an encoder that uses the BSAC encodes audio data, in contrast with the encoder that uses the AAC, the encoder that uses the BSAC can generate a base layer and at least one enhancement layer by dividing the audio data according to frequency bands, encode all of the layers of the audio data, and transmit only the audio data of selected encoded layers that include the base layer to a decoder. Here, since the selected layers are variable, the bit rate of the audio data encoded using the BSAC may be adjusted.

In contrast with the easy combination of the ACC and SBR techniques, combining the BSAC and SBR techniques incurs certain difficulties. That is, some of the encoded audio data layers to be transmitted to the decoder may vary on a case by case basis, and thus, different SBR data should be generated for all possible cases.

There is a demand for a scheme that is able to recover encoded audio data having layers using SBR data that is identical, regardless of the selected layers of the audio data to be transmitted to a decoder.

SUMMARY OF THE INVENTION

An audio data encoding apparatus generates a bitstream comprising encoded spectral band replication (SBR) data and encoded audio data whose bitrate may be adjusted because the audio data is divided into a plurality of layers.

An audio data decoding apparatus decodes the audio data included in a to-be-decoded bitstream to recover audio data in the same frequency band as the frequency band of the audio data included in the bitstream and decodes the SBR data included in the bitstream, which is identical regardless of a content of the layers of the audio data included in the bitstream, to recover audio data in a frequency band of frequencies greater than the maximum frequency of the audio data included in the bitstream.

An audio data encoding method generates a bitstream comprising encoded spectral band replication (SBR) data and encoded audio data whose bitrate may be adjusted because the audio data is divided into a plurality of layers.

An audio data decoding method decodes the audio data included in a to-be-decoded bitstream to recover audio data in the same frequency band as the frequency band of the audio data included in the bitstream and decodes the SBR data included in the bitstream, which is identical regardless of a content of the layers of the audio data included in the bitstream, to recover audio data in a frequency band of frequencies greater than the maximum frequency of the audio data included in the bitstream.

A computer-readable recording medium may store a computer program to generate a bitstream comprising encoded spectral band replication (SBR) data and encoded audio data whose bitrate may be adjusted because the audio data is divided into a plurality of layers.

A computer-readable recording medium may store a computer program to decode the audio data included in a to-be-decoded bitstream to recover audio data in a same frequency band as the frequency band of the audio data included in the bitstream and decode the SBR data included in the bitstream, which is identical regardless of a content of the layers of the audio data included in the bitstream, to recover audio data in a frequency band of frequencies greater than the maximum frequency of the audio data included in the bitstream.

According to an aspect of the present invention, an audio data encoding apparatus comprises: a scalable encoding unit dividing audio data into a plurality of layers, representing the audio data in predetermined numbers of bits in each of the plurality of layers, and encoding the lower layer prior to encoding the upper layer and the upper bit of each layer prior to encoding the lower bit thereof; an SBR encoding unit generating SBR (spectral band replication) data that has information about audio data in a frequency band of frequencies equal to or greater than a predetermined frequency among the audio data to be encoded, and encoding the SBR data; and a bitstream production unit generating a bitstream using the encoded SBR data and the encoded audio data corresponding to a predetermined bitrate.

According to another aspect of the present invention, an audio data decoding apparatus comprises: a bitstream analysis unit extracting encoded SBR data and encoded audio data corresponding to at least one layer, the layer being expressed in predetermined numbers of bits, from a given bitstream; a scalable decoding unit decoding the encoded audio data by decoding a lower layer prior to decoding an upper layer and the upper bit of each layer prior to decoding the lower bit of each layer; a SBR decoding unit decoding the encoded SBR data, and inferring audio data in a frequency band between a first frequency and a second frequency based on the decoded audio data and the decoded SBR data; and a data synthesis unit generating synthetic data by using the decoded audio data and the inferred audio data and outputting the synthetic data as the audio data in the frequency band between 0 and the second frequency, wherein the second frequency is equal to or greater than a maximum frequency of the at least one layer, and the SBR data comprises information about the audio data in the frequency band between the first and the second frequencies.

According to an aspect of the present invention, an audio data encoding method comprises: (a) dividing audio data into a plurality of layers, representing the layers of the audio data in predetermined numbers of bits, and encoding the lower layers prior to encoding the upper layers and the upper bits of each layer prior to encoding the lower bits thereof; (b) generating SBR (spectral band replication) data that has information about audio data in a frequency band of frequencies equal to or greater than a predetermined frequency among the audio data to be encoded, and encoding the SBR data; and (c) generating a bitstream using the encoded SBR data and the encoded audio data corresponding to a predetermined bitrate.

According to another aspect of the present invention, an audio decoding method comprises: (a) extracting encoded SBR data and encoded audio data corresponding to at least one layer, the layer being expressed in predetermined numbers of bits, from a given bitstream; (b) decoding the encoded audio data by decoding a lower layer prior to decoding an upper layer and the upper bit of each layer prior to decoding the lower bit of each layer; (c) decoding the encoded SBR data, and inferring audio data in a frequency band between a first frequency and a second frequency based on the decoded audio data and the decoded SBR data; and (d) generating synthetic data by using the decoded audio data and the inferred audio data and determining the synthetic data to be the audio data in the frequency band between 0 and the second frequency, wherein the second frequency is equal to or greater than the maximum frequency of the at least one layer, and the SBR data comprises information with respect to the audio data in the frequency band between the first and the second frequencies.

According to an aspect of the present invention, a computer-readable recording medium may store a computer program that executes a method comprising: (a) dividing audio data into a plurality of layers, representing the layers of the audio data in predetermined numbers of bits, and encoding the lower layers prior to encoding the upper layers and the upper bits of each layer prior to encoding the lower bits thereof; (b) generating SBR (spectral band replication) data that has information with respect to audio data in a frequency band of frequencies equal to or greater than a predetermined frequency among the audio data to be encoded, and encoding the SBR data; and (c) generating a bitstream using the encoded SBR data and the encoded audio data corresponding to a predetermined bitrate.

According to another aspect of the present invention, a computer-readable recording medium may store a computer program that executes a method comprising: (a) extracting encoded SBR data and encoded audio data corresponding to at least one layer, the layer being expressed in predetermined numbers of bits, from a given bitstream; (b) decoding the encoded audio data by decoding a lower layer prior to decoding an upper layer and the upper bit of each layer prior to decoding the lower bit of each layer; (c) decoding the encoded SBR data, and inferring audio data in a frequency band between a first frequency and a second frequency based on the decoded audio data and the decoded SBR data; and (d) generating synthetic data by using the decoded audio data and the inferred audio data and determining the synthetic data to be the audio data in the frequency band between 0 and the second frequency, wherein the second frequency is equal to or greater than the maximum frequency of the at least one layer, and the SBR data comprises information with respect to the audio data in the frequency band between the first and the second frequencies.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 6 illustrates a syntax of data that is encoded by the audio-data encoding apparatus of FIG. 1;

FIG. 7 illustrates a syntax of SBR data that is generated by the audio-data encoding apparatus of FIG. 1;

DETAILED DESCRIPTION OF THE PREFERRED EMBODIMENTS

Figure 1:
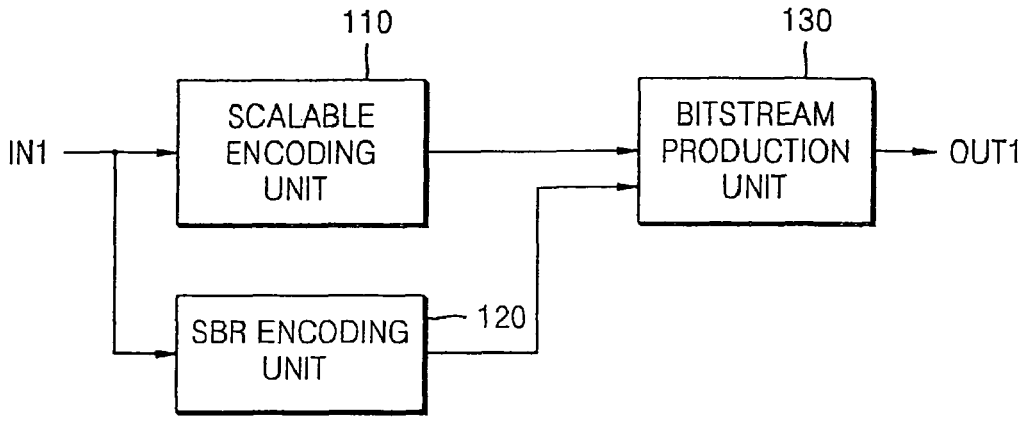
FIG. 1 is a block diagram of an audio-data encoding apparatus according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a block diagram of an audio-data encoding apparatus according to an embodiment of the present invention, which includes a scalable encoding unit 110, a spectral band replication (SBR) encoding unit 120, and a bitstream production unit 130. An operation of the audio-data encoding apparatus of FIG. 1 will now be described with reference to FIGS. 2 through 4.

The scalable encoding unit 110 encodes audio data received via an input port IN1 by dividing the received audio data into a plurality of layers, representing the layers in predetermined numbers of bits, and encoding the lower layers prior to encoding the upper layers. When a layer is encoded, the upper bits of the layer are encoded prior to encoding the lower bits of the layer.

More specifically, the scalable encoding unit 110 converts the audio data in the time domain into audio data in the frequency domain. For example, the scalable encoding unit 110 may perform the conversion using a modified discrete cosine transform (MDCT) method.

Figure 2:
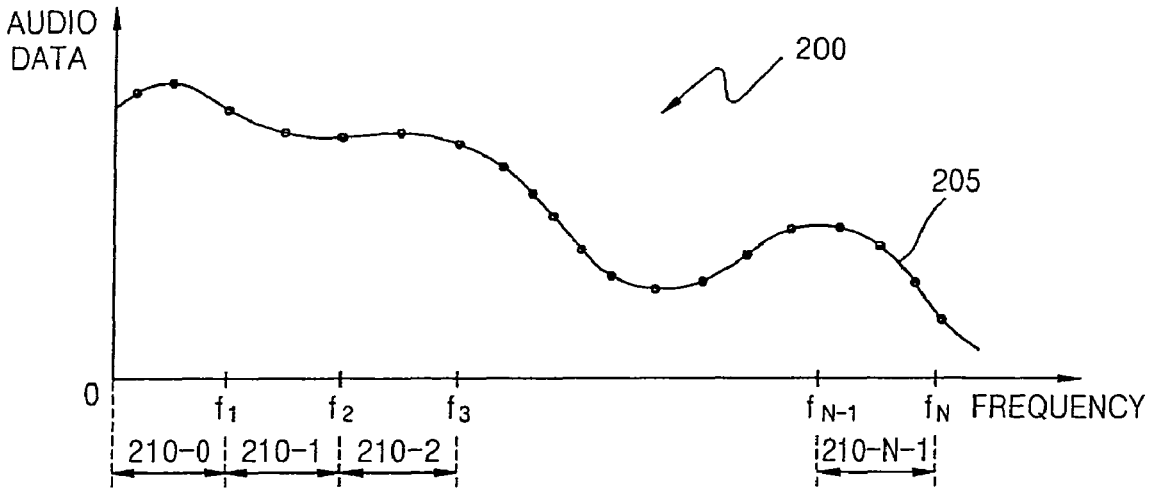
FIG. 2 is a graph illustrating audio data 200, which is an embodiment of the audio data in FIG. 1, the audio data 200 including a base layer and at least one enhancement layer.

Then, the scalable encoding unit 110 divides the frequency-domain audio data into the plurality of layers. The layers include a base layer and at least one enhancement layer. The layers are divided according to a frequency band. FIG. 2 is a graph to illustrate audio data 200, which is utilized in an embodiment of the audio-data encoding apparatus of FIG. 1. The audio data 200 includes a base layer 210-0 and a plurality of enhancement layers 210-1, 210-2, . . . , and 210-N−1. As shown in FIG. 2, the layers 210-0, 210-1, 210-2, . . . , and 210-N−1 comprise N (where N denotes an integer equal to or greater than 2) layers. The enhancement layers 210-1, 210-2, . . . , and 210-N−1 are referred to as first, second, . . . , and (N−1)th enhancement layers, respectively. The frequency band of the audio data 200 is 0 to $f_N$ [kHz]. Reference numeral 205 denotes an envelope that is represented by the audio data 200. Consequently, the lowest layer is the base layer 210-0, and the highest layer is the (N−1)th enhancement layer 210-N−1.

The scalable encoding unit 110 quantizes the divided audio data. In the embodiment of FIG. 2, the scalable encoding unit 110 of FIG. 1 quantizes the divided audio data 200 as indicated by dots.

The scalable encoding unit 110 represents the quantized divided audio data in a predetermined number of bits. Different numbers of bits may be allocated according to the type of a layer.

The scalable encoding unit 110 hierarchically encodes the quantized audio data. For example, the scalable encoding unit 110 may encode the quantized audio data using bit sliced arithmetic coding (BSAC).

Audio data transmitted to an audio-data decoding apparatus according to an embodiment of the present invention may be the entire audio data, namely, audio data of all of the layers, or partial audio data, namely, audio data of some of the layers. Here, the certain layers transmitted to the audio data decoding apparatus denote at least one layer, including the base layer 210-0. As such, when certain of the layers of the audio data are transmitted to the audio-data decoding apparatus, the audio data corresponding to the certain layers is desirably encoded prior to encoding the audio data corresponding to the other residual layers.

To achieve this, the scalable encoding unit 110 encodes the quantized audio data so that the lower layers are encoded prior to encoding the upper layers and the upper bits of each layer are encoded prior to encoding the lower bits thereof. Hence, the scalable encoding unit 110 encodes the audio data of the lowest layer 210-0 at the very first and encodes the audio data of the highest layer 210-N−1 at the very last. Furthermore, when the scalable encoding unit 110 encodes the audio data of each layer, it encodes at least one most significant bit (MSB) among the audio data at the very first encoding of the layer and at least one least significant bit (LSB) at the very last of encoding of the layer. This encoding sequence is derived from the fact that significant information included in audio data is generally more distributed in lower layers than in upper layers, and furthermore, more in the upper bits of each layer than in the lower bits thereof.

In this way, the scalable encoding unit 110 encodes all of the layers of the audio data.

Figure 3:
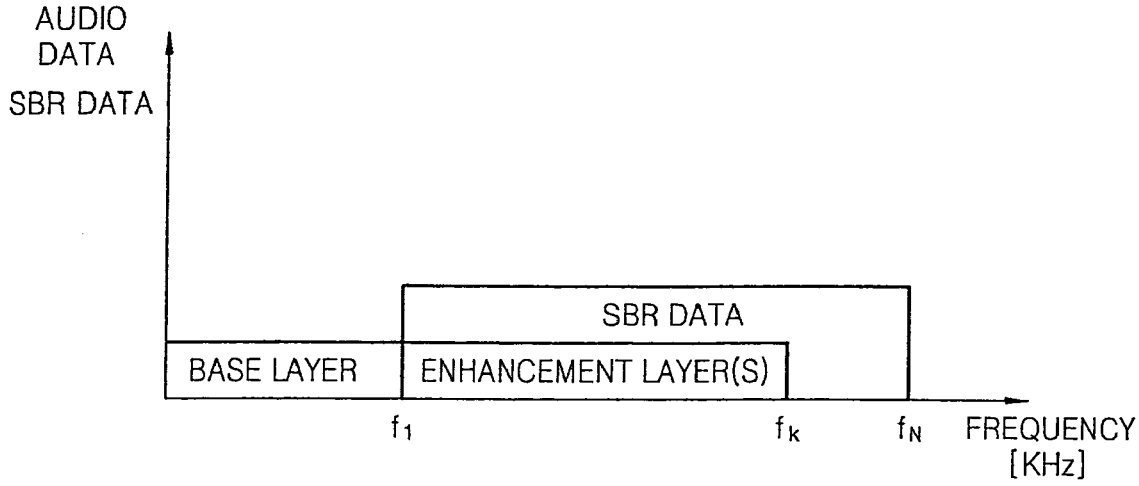
FIG. 3 is a reference diagram to compare the frequency band of spectral band replication (SBR) data with the frequency bands of certain layers transmitted to an audio-data decoding apparatus according to an embodiment of the present invention.

The SBR encoding unit 120 generates SBR data and encodes the same. The SBR data according to the present invention, denotes data including information about audio data in a frequency band between a first frequency and a second frequency. The first frequency may be a frequency equal to or greater than the maximum frequency $f_1$ of the base layer 210-0. The first frequency is generally the maximum frequency $f_1$ of the base layer 210-0. The second frequency may be generally, a frequency equal to or greater than the maximum frequency $f_k$ of the highest layer among the some layers that are transmitted to the audio-data decoding apparatus, more generally, the maximum frequency $f_N$ of the encoded audio data of all layers. FIG. 3 is a reference diagram to compare the frequency band $f_1$-$f_N$ of the SBR data with the frequency band 0-$f_k$ of the some layers transmitted to the audio-data decoding apparatus according to an embodiment of the present invention. In FIG. 3, k denotes an integer between 2 and N. However, when only the base layer 210-0 is transmitted to the audio-data decoding apparatus, k is equal to 1.

The information with respect to the audio data may denote information with respect to noise of the audio data or information with respect to the envelope 205 of the audio data.

More specifically, the SBR encoding unit 120 may generate SBR data using the information with respect to the envelope 205 of the audio data in the frequency band between the first and second frequencies and perform lossless encoding on the generated SBR data. Herein, the lossless encoding is entropy encoding or Huffman encoding.

Figure 4:
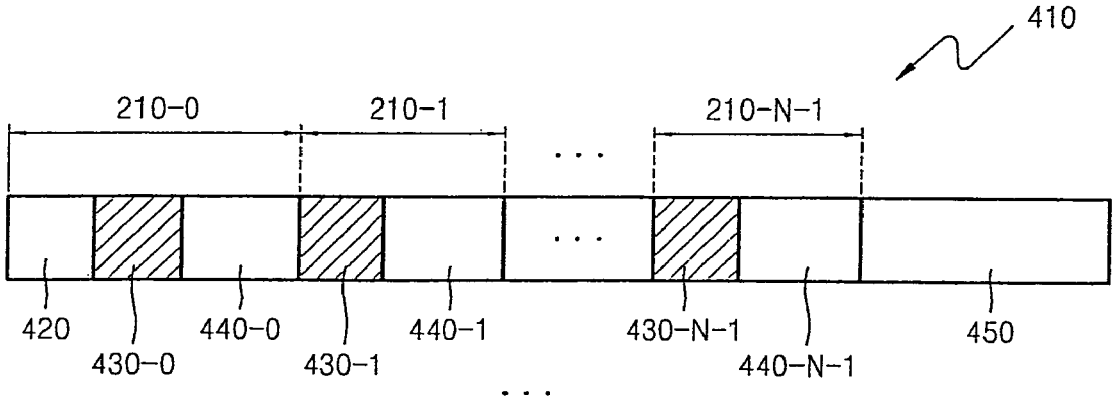
FIG. 4 illustrates a structure of an embodiment of a bitstream that is generated by the audio-data encoding apparatus of FIG. 1.

The bitstream production unit 130 generates a bitstream using the Huffman-encoded SBR data and audio data corresponds to a predetermined bitrate among the encoded audio data of all of the layers, and outputs the bitstream via an output port OUT1. FIG. 4 illustrates a structure of a bitstream 410, which is an embodiment of the bitstream generated by the audio-data encoding apparatus of FIG. 1. As shown in FIG. 4, the bitstream 410 includes a header 420, information 430-0 about the number of bits in which the audio data of the base layer 210-0 is represented, information 440-0 about the encoded audio data of the base layer 210-0 and the step size of quantization on the base layer 210-0, information 430-n, information 440-n, and SSR data 450. The information 430-n indicates the number of bits in which the audio data of an n-th enhancement layer 210-n (where n is an integer satisfying $1 \leqq n \leqq N-1$) is represented. The information 440-n indicates the encoded audio data of the n-th enhancement layer 210-n and the step size of quantization on the n-th enhancement layer 210-n. As shown in FIG. 4, the encoded audio data 430-0, 430-1, . . . , and 430-N−1 of the bitstream 410 are allocated for the respective layers 210-0, 210-1, . . . , and 210-N−1. However, the encoded SBR data 450 included in the bitstream 410 is not allocated for each of the layers.

The predetermined bitrate denotes the bitrate of the audio data of the certain layers to be transmitted to the audio-data decoding apparatus among the audio data included in all the encoded layers. In other words, the predetermined bitrate is equal to or greater than the bitrate of the base layer 210-0.

Figure 5:
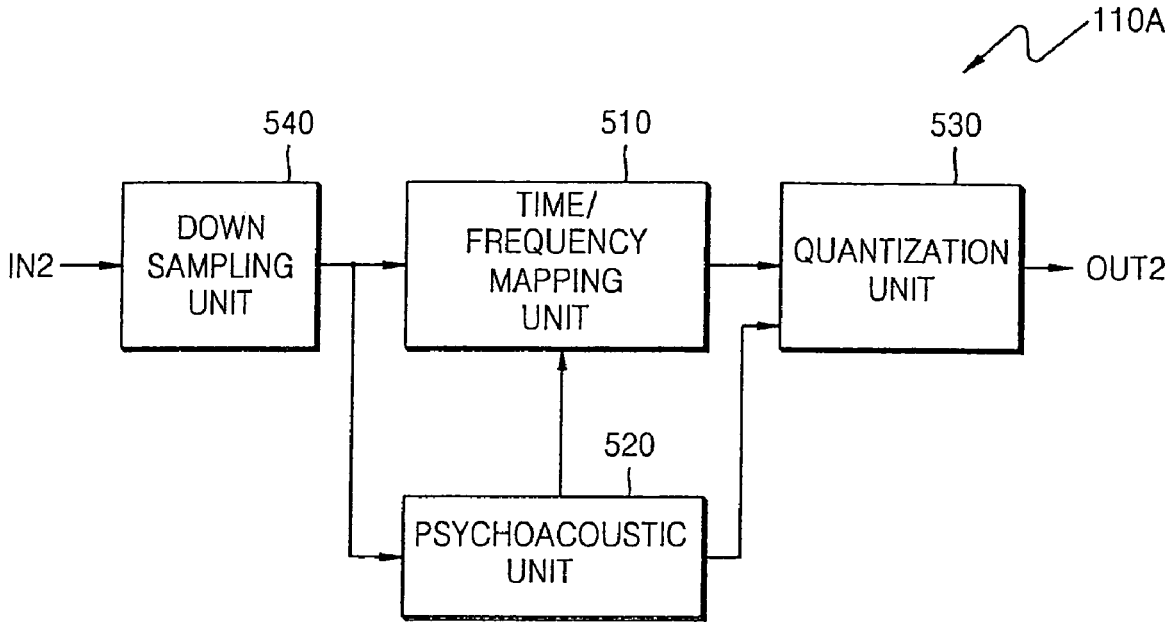
FIG. 5 is a block diagram of a scalable encoding unit 110A, which is an embodiment of a scalable encoding unit 110 shown in FIG. 1.

FIG. 5 is a block diagram of a scalable encoding unit 110A, which is an embodiment of the scalable encoding unit 110 shown in FIG. 1. The scalable encoding unit 110A includes a time/frequency mapping unit 510, a psychoacoustic unit 520, a quantization unit 530, and a down sampling unit 540.

The time/frequency mapping unit 510 converts audio data in the time domain received via an input port IN2 into audio data in the frequency domain. The input port IN2 may be the same as the input port IN1. Frequency of the audio data in the time domain is a predetermined sampling frequency Fs. In addition, the audio data in the time domain is a discrete audio data.

The psychoacoustic unit 520 groups the audio data output by the time/frequency mapping unit 510 according to a frequency band to generate a plurality of layers.

The quantization unit 530 quantizes audio data of each of the layers and encodes the quantized audio data of all of the layers so that the lower layers are encoded prior to encoding the upper layers and the upper bits of each layer are encoded prior to encoding the lower bits thereof. The quantization unit 530 outputs the result of the encoding to the bitstream production unit 130 via an output port OUT2.

The down sampling unit 540 is optional. The down sampling unit 540 samples the audio data in the time domain at a sampling frequency that is less than the predetermined sampling frequency Fs, that is, at Fs/2, and outputs the result of the sampling to the time/frequency mapping unit 510 and the psychoacoustic unit 520.

FIG. 6 illustrates a syntax of the audio data that is encoded by the audio-data encoding apparatus of FIG. 1. Reference numeral 610 denotes audio data encoded according to the BSAC technique, and reference numeral 620 denotes data that may be combined with the audio data 610. The data 620 includes multi-channel extended data EXT_BSAC_CHANNEL 650, spectral band replication data EXT_BSAC_SBR_DATA 660, and 'error detection data and SBR data' EXT_BSAC_SBR_DATA_CRE 670.

Figure 16:
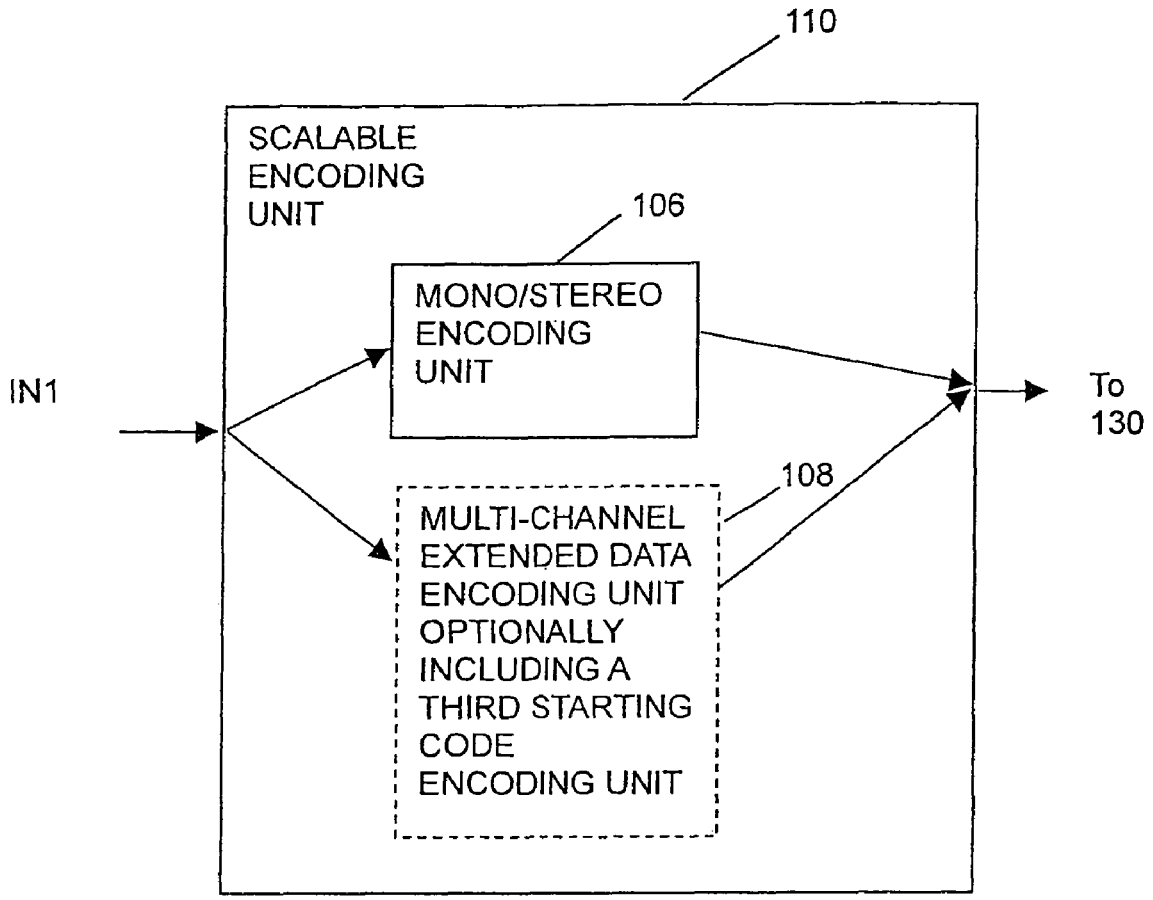
FIG. 16 is a block diagram of a scalable encoding unit in accordance with an embodiment of the present invention.

The multi-channel extended data EXT_BSAC_CHANNEL 650 denotes audio data of third through M-th (where M denotes an integer equal to or greater than 3) channels. When the audio data given to the audio-data encoding apparatus of FIG. 1 is audio data given via 3 or more channels, the third through M-th channels denote the channels other than a mono channel (i.e., a first channel) and a stereo channel (i.e., first and second channels). As such, if audio data is given via three or more channels, as shown in FIG. 16, the scalable encoding unit 110 may include a mono/stereo encoding unit 106 and a multi-channel extended data encoding unit 108. The mono/stereo encoding unit 106 encodes audio data of the first or second channel. The multi-channel extended encoding unit 108 encodes audio data of each of the third through M-th channels. The error detection data denotes data that is used in detecting an error from the spectral band replication data EXT_BSAC_SBR_DATA 660. Moreover, EXT_BSAC_SBR_DATA_CRE 670 denotes the error detection data and the SBR data.

The audio data being encoded by the audio-data encoding apparatus may further include starting codes 630 and 640, indicating the start of the combinable data 620, in addition to the audio data 610 and the combinable data 620. The starting code 630 and 640 may be one of a first starting code, a second starting code, and a third starting code.

Figure 17:
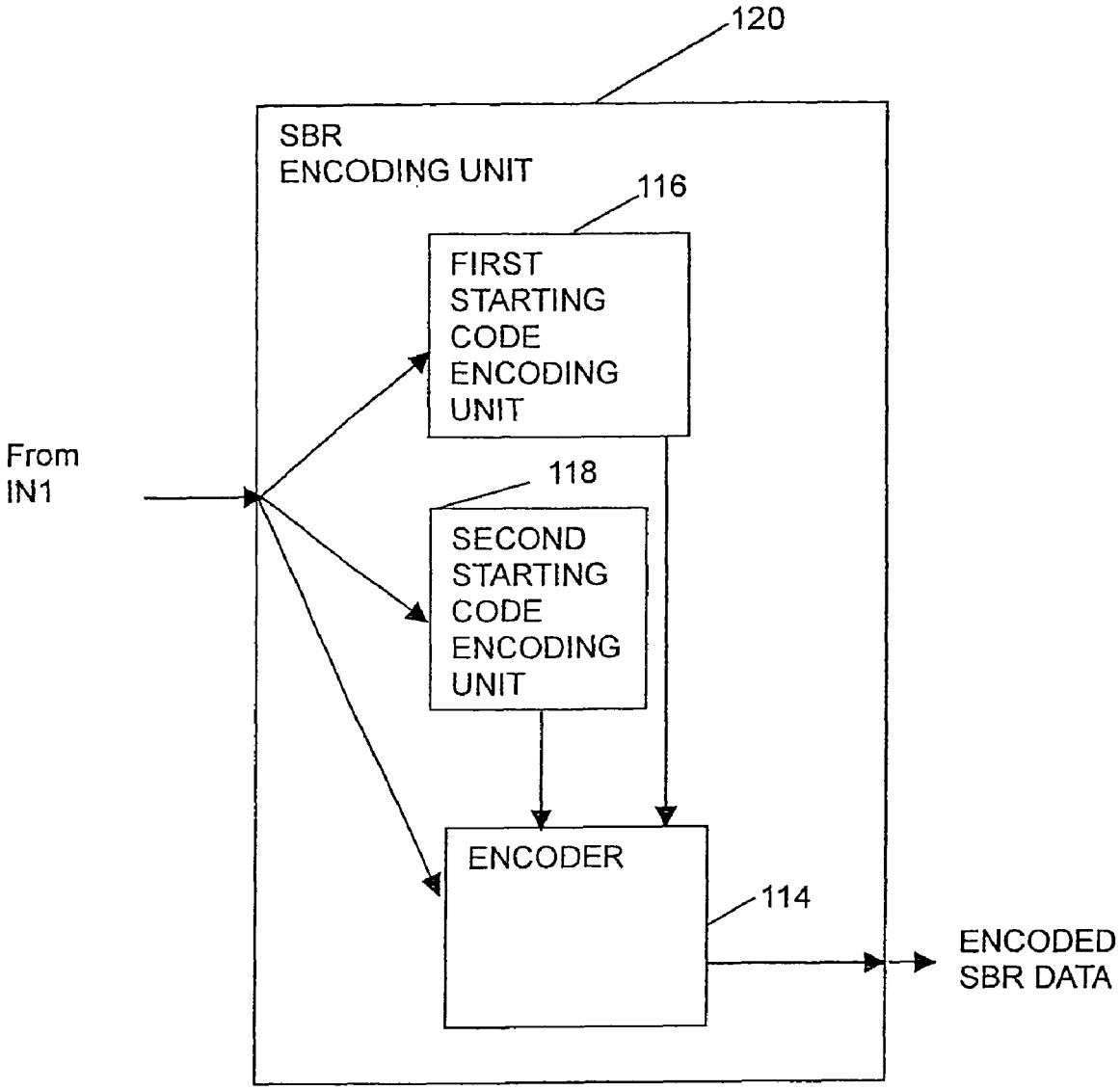
FIG. 17 is a block diagram of a SBR encoding unit in accordance with an embodiment of the present invention.

The first starting code indicates the start of the SBR data EXT_BSAC_SBR_DATA 660. More specifically, the first starting code may include a zero code zero_code 630 represented in 32 bits of 0 and an extension code extension_type 640 represented in '1111 0000'. As shown in FIG. 17, the SBR encoding unit may include a first starting code encoding unit 116 for encoding the first starting code and an encoder 114, wherein the encoder 114 encodes SBR data after the first starting code is encoded.

The second starting code indicates the start of the error detection data and the SBR data EXT_BSAC_SBR_DATA_CRE 670. More specifically, the second starting code may include the zero code zero_code 630, which is represented in 32 bits of 0, and an extension code extension_type 640 represented in '1111 0001'. As shown in FIG. 17, the SBR encoding unit may include a second starting code encoding unit 118 for encoding the second starting code and the encoder 114, wherein the encoder 114 encodes SBR data after the second starting code is encoded.

The third starting code indicates the start of the audio data of the third through M-th channels. More specifically, the third starting code may include the zero code zero_code 630, which is represented in 32 bits of 0, and an extension code extension_type 640 represented in '1111 1111'. The multi-channel extended data encoding unit may include a third starting code encoding unit (optionally part of 108) for encoding the third starting code.

FIG. 7 illustrates a syntax of the SBR data that is generate by the audio-data encoding apparatus of FIG. 1. The audio data to be encoded by the audio-data encoding apparatus of FIG. 1 may be given through the first channel or the second channel. Data bsac_sbr_data(nch, bs_amp_res) 710 indicates that the SBR encoding unit 120 encodes SBR data for each of the channels.

Figure 8:
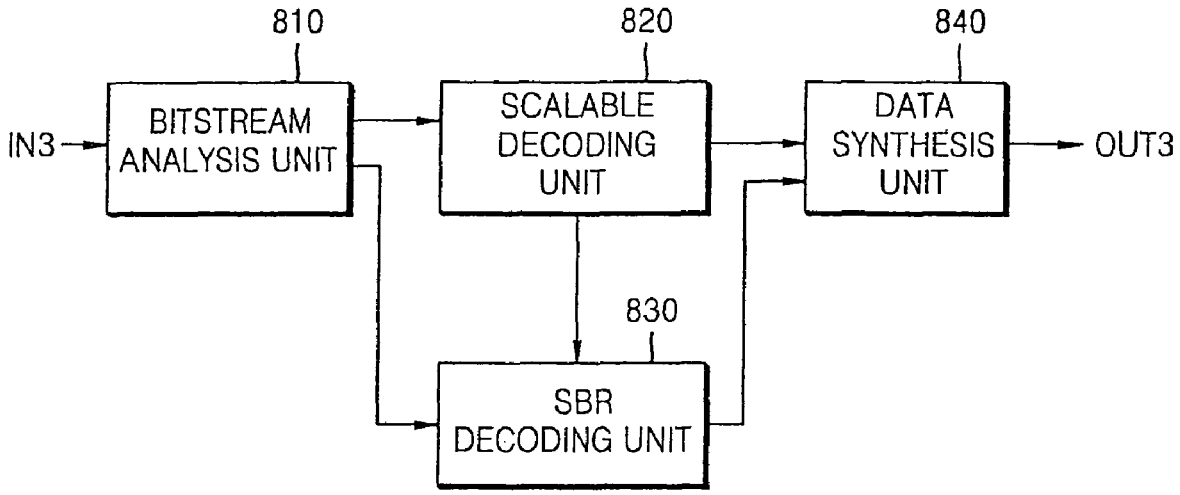
FIG. 8 is a block diagram of an audio-data decoding apparatus according to an embodiment of the present invention.

FIG. 8 is a block diagram of the audio-data decoding apparatus according to an embodiment of the present invention, which includes a bitstream analysis unit 810, a scalable decoding unit 820, an SBR decoding unit 830, and a data synthesis unit 840.

The bitstream analysis unit 810 extracts 'encoded SBR data' and 'encoded audio data having at least one layer, each of the layers being expressed in a predetermined number of bits' from a bitstream received via an input port IN3. The bitstream may be the bitstream output via the output port OUT1. In other words, the bitstream analysis unit 810 extracts 'the SBR data generated by the SBR encoding unit 120' and 'the audio data corresponding to at least one layer among the entire audio data of all of the layers that are generated by the scalable encoding unit 110' from the bitstream received via the input port IN3.

The scalable decoding unit 820 decodes the extracted audio data by decoding the audio data of lower layers prior to decoding the audio data of upper layers and the upper bits of each layer prior to decoding the lower bits thereof. The decoding of the extracted audio data by the scalable decoding unit 820 may be performed at or below the predetermined bitrate. For example, when the audio data included in the bitstream generated by the bitstream production unit 130 among the audio data encoded by the scalable encoding unit 110 are the audio data of the base layer 210-0 and the first and second enhancement layers 210-1 and 210-2, the scalable decoding unit 820 may decode all of the audio data of the base layer 210-0 and the first and second enhancement layers 210-1 and 210-2, or only the audio data of the base layer 210-0 and the first enhancement layer 210-1, or only the audio data of the base layer 210-0. The predetermined bitrate may be equal to or greater than the bitrate of the base layer 210-0.

Figure 18:
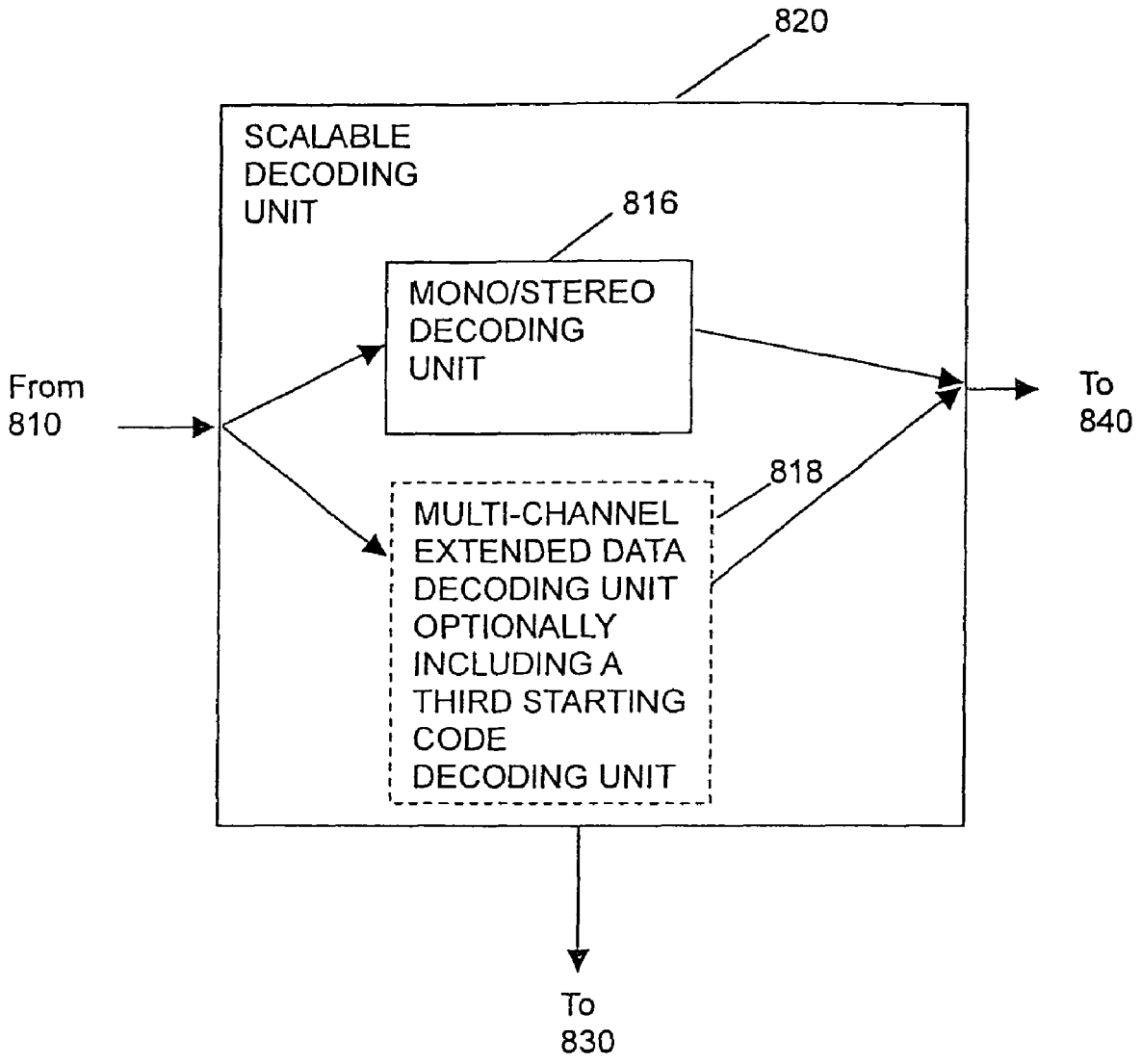
FIG. 18 is a block diagram of a scalable decoding unit according to an embodiment of the present invention.

In the case that encoded audio data is included in the received bitstream for each of the first through M-th channels, as shown in FIG. 18, the scalable decoding unit 820 may include a mono/stereo decoding unit 816, a multi-channel extended data decoding unit 818, and a third starting code decoding unit (optionally part of 818). The mono/stereo decoding unit 816 decodes the encoded audio data of the first or second channel. The multi-channel extended data decoding unit 818 decodes the encoded audio data of each of the third through M-th channels. The third starting code decoding unit (optionally part of 818) decodes the encoded third starting code. As such, when the scalable decoding unit 820 includes the multi-channel extended data decoding unit 818, the bitstream analysis unit 810 determines if the encoded third starting code is included in the received bitstream. When it is determined that the encoded third starting code is included in the received bitstream, the bitstream analysis unit 810 extracts the encoded third starting code from the received bitstream, and the third starting code decoding unit (optionally part of 818) decodes the extracted third starting code and directs the multi-channel extended data decoding unit to operate.

The SBR decoding unit 830 decodes the extracted SBR data. The SBR decoding unit 830 infers the audio data in the frequency band between the first and second frequencies based on the audio data received from the scalable decoding unit 820 and the decoded SBR data.

Figure 19:
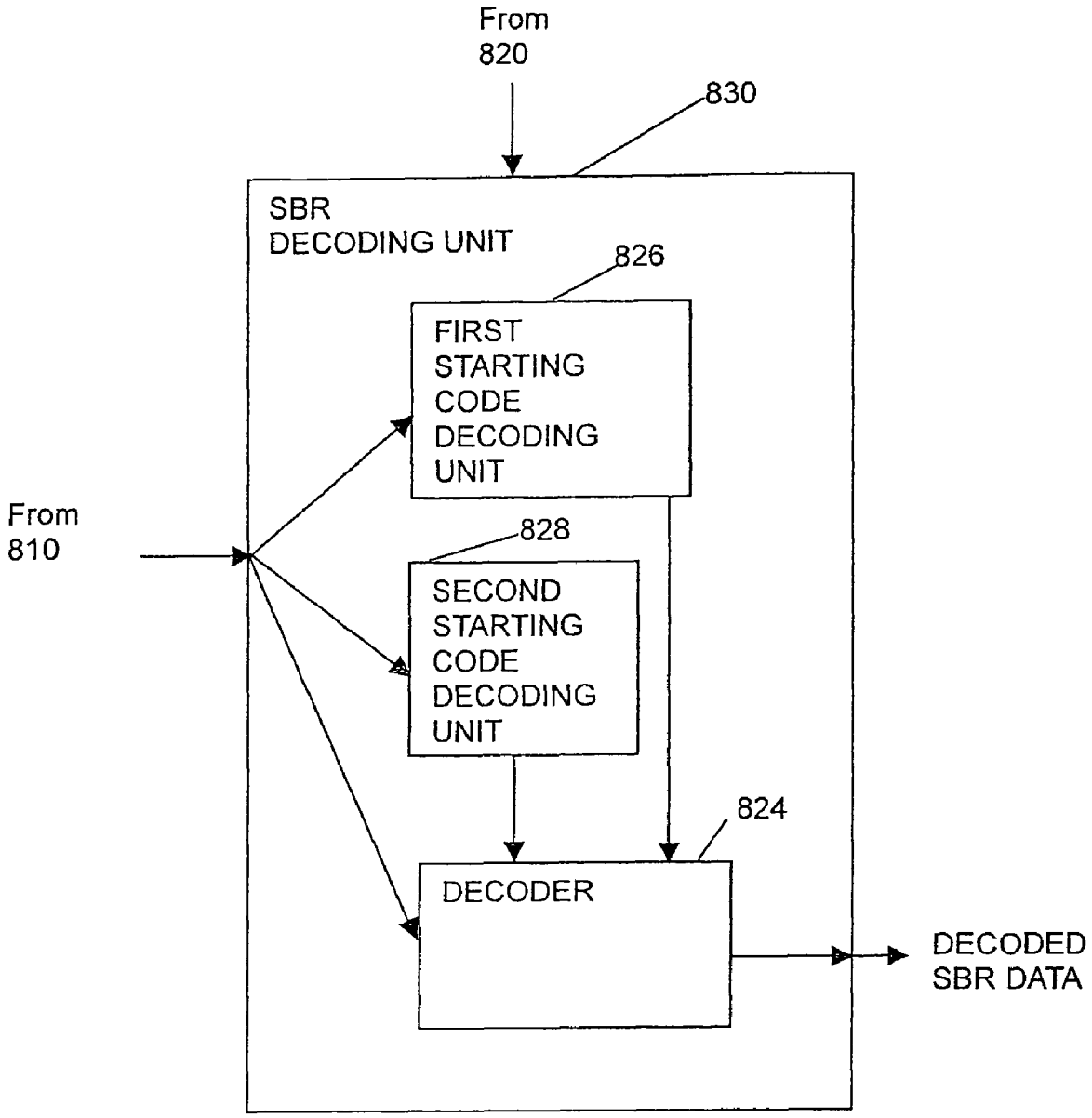
FIG. 19 is a block diagram of a SBR decoding unit in accordance with an embodiment of the present invention.

As shown in FIG. 19, the audio data decoding apparatus may include a first starting code decoding unit 826, a second starting code decoding unit 828, and a decoder 824. In this case, the bitstream analysis unit 810 determines if the encoded first and second starting codes are included in the received bitstream. When it is determined that the encoded first and second starting codes are included in the received bitstream, the bitstream analysis unit 810 extracts the encoded first and second starting codes from the received bitstream, and the first and second starting code decoding units 826, 828 decode the extracted first and second starting codes, respectively. Then, the first and second starting code decoding units 826, 828 direct the SBR decoding unit 830 to operate and the decoder 824 decodes the encoded SBR data.

The data synthesis unit 840 generates synthetic data from the audio data received from the scalable decoding unit 820 and the audio data inferred by the SBR decoding unit 830. The data synthesis unit 840 also converts the synthetic data, which is data in the frequency domain, into synthetic data in the time domain and outputs the synthetic data in the time domain as the audio data in the frequency band ranging from 0 to the second frequency via an output port OUT3. In other words, when the maximum frequency of the entire audio data encoded by the audio data encoding apparatus is the second frequency, although the audio data included in the bitstream is only the audio data of some of the layers, the data synthesis unit 840 recovers the audio data of all of the layers.

Figure 9A:
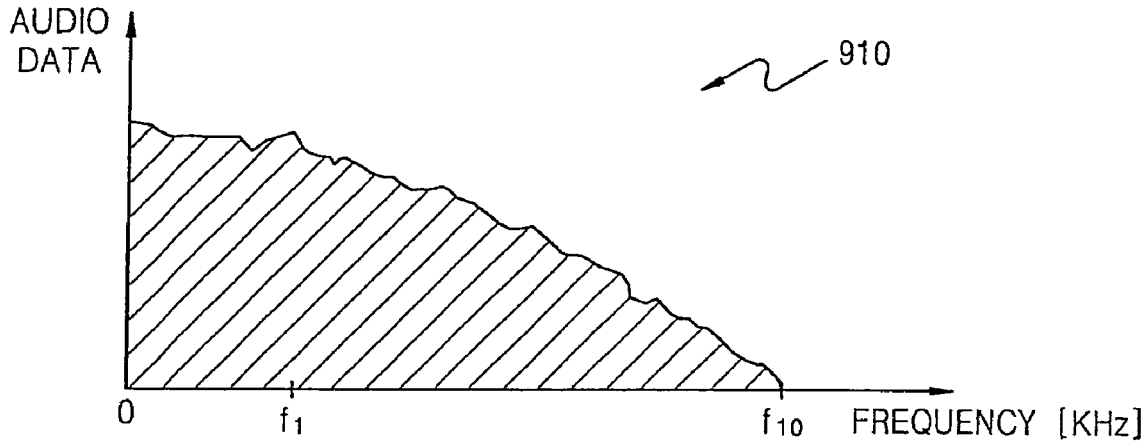
FIGS. 9A through 9D are graphs illustrating generation of synthetic data by the audio-data decoding apparatus of FIG. 1.
Figure 9B:
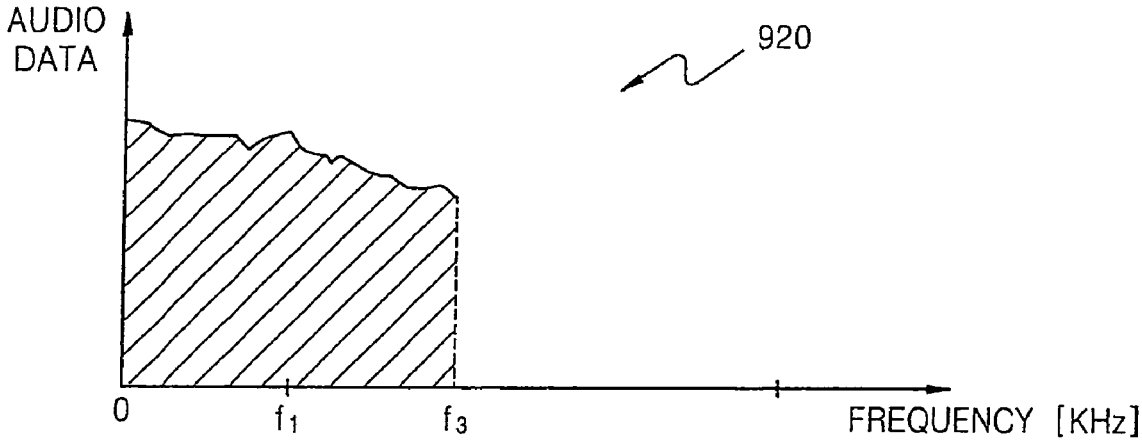
Figure 9C:
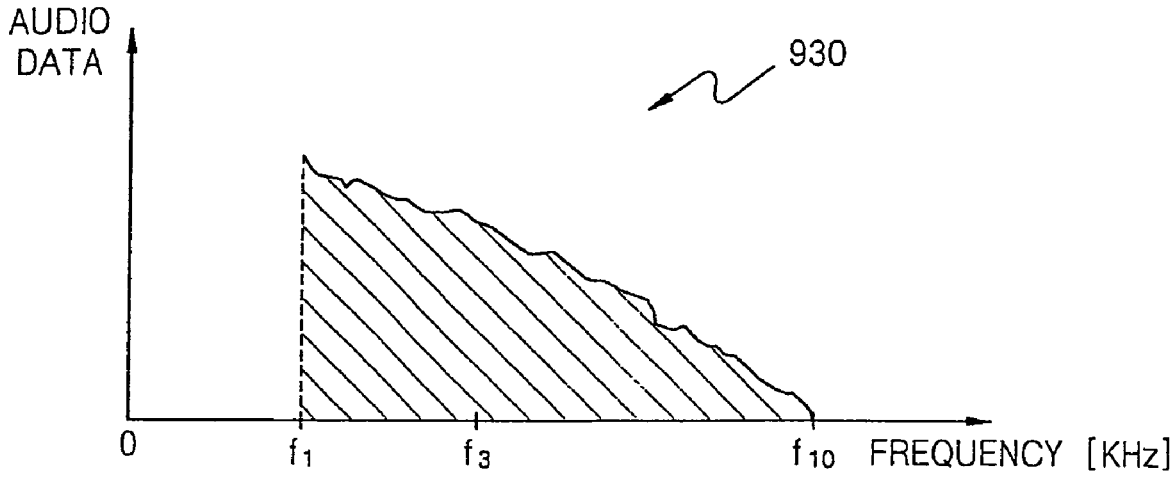
Figure 9D:
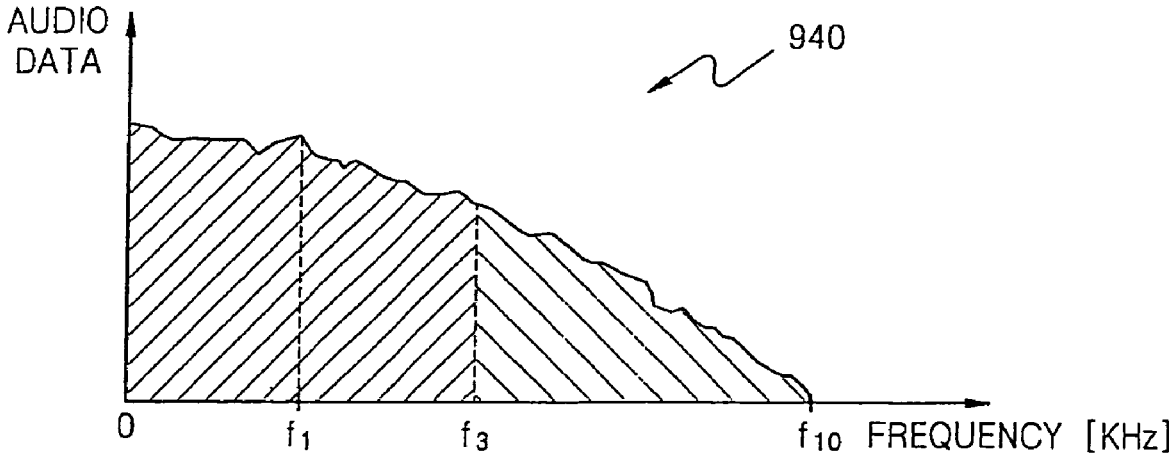

FIGS. 9A through 9D are graphs illustrating the operation of the data synthesis unit 840 in greater detail. FIG. 9A illustrates audio data 910 input to the scalable encoding unit 110, FIG. 9B illustrates audio data 920 decoded by the scalable decoding unit 820, FIG. 9C illustrates audio data 930 inferred by the SBR decoding unit 830, and FIG. 9D illustrates synthetic data 940 generated by the data synthesis unit 840, that is, a result of the reconstructing of the audio data in a frequency band between zero and a second frequency.

For ease in explanation, it is illustrated in FIGS. 9A through 9D that the audio data 910, 920, 930, and 940 are continuous data. However, actually, the audio data 910, 920, 930, and 940 are discrete data.

As shown in FIG. 9A, the audio data 910 input to the scalable encoding unit 110 exist in a frequency band from 0 to $f_{10}$ kHz. The audio data 920 decoded by the scalable decoding unit 820 exist in a frequency band from 0 to $f_3$ kHz. The bitstream may include the encoded audio data of all the layers or the audio data of certain of the layers. In FIG. 9B, the bitstream includes only the audio data of certain of the layers, that is, only the audio data in the frequency band from 0 to $f_3$ kHz. It is desirable that the certain layers always include the base layer in the frequency band from 0 to $f_1$ kHz.

The audio data 930 inferred by the SBR decoding unit 830 exists in a frequency band from $f_1$ to $f_{10}$ kHz. The synthetic data 940 generated by the data synthesis unit 840 exists in a frequency band from 0 to $f_{10}$ kHz. In other words, the synthetic data 940 is the result of decoding of the audio data 910. The audio data 940 and 910 may be different to some degree, but are desired to be identical with each other.

The data synthesis unit 840 outputs the decoded audio data 920 as synthetic data for the frequency band (i.e., from 0 to $f_3$ kHz) where the decoded audio data 920 exists.

The data synthesis unit 840 outputs the inferred audio data 930 as synthetic data for the frequency band (i.e., from $f_3$ to $f_{10}$ kHz) where the decoded audio data 920 does not exist.

As a result, the data synthesis unit 840 determines the decoded audio data 920 to be synthetic data for the frequency band (i.e., from $f_1$ to $f_3$ kHz) where both the decoded audio data 920 and the inferred audio data 930 exist.

Figure 10:
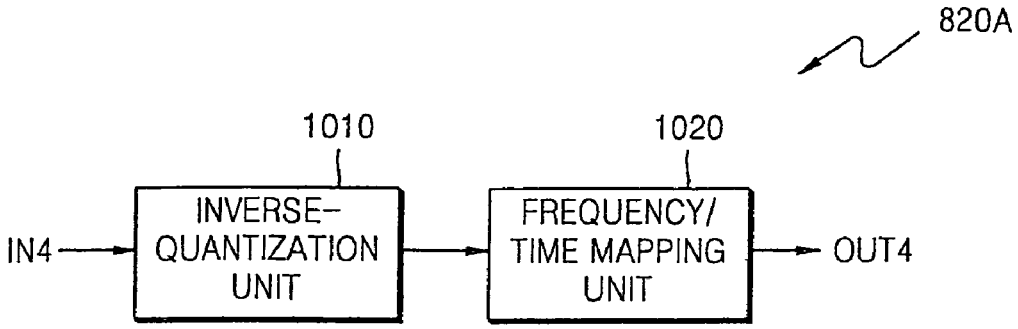
FIG. 10 is a block diagram of a scalable decoding unit 820A, which is an embodiment of a scalable decoding unit 820 shown in FIG. 8.

FIG. 10 is a block diagram of a scalable decoding unit 820A, which is an embodiment of the scalable decoding unit 820 shown in FIG. 8. The scalable decoding unit 820A includes an inverse-quantization unit 1010 and a frequency/time mapping unit 1020.

The inverse-quantization unit 1010 receives 'the exacted audio data' via an input port IN4, decodes the received audio data, and inversely quantizes the decoded audio data. The frequency/time mapping unit 1020 converts the inversely quantized audio data in the frequency domain into audio data in the time domain and outputs the audio data in the time domain via an output port OUT4.

Figure 11:
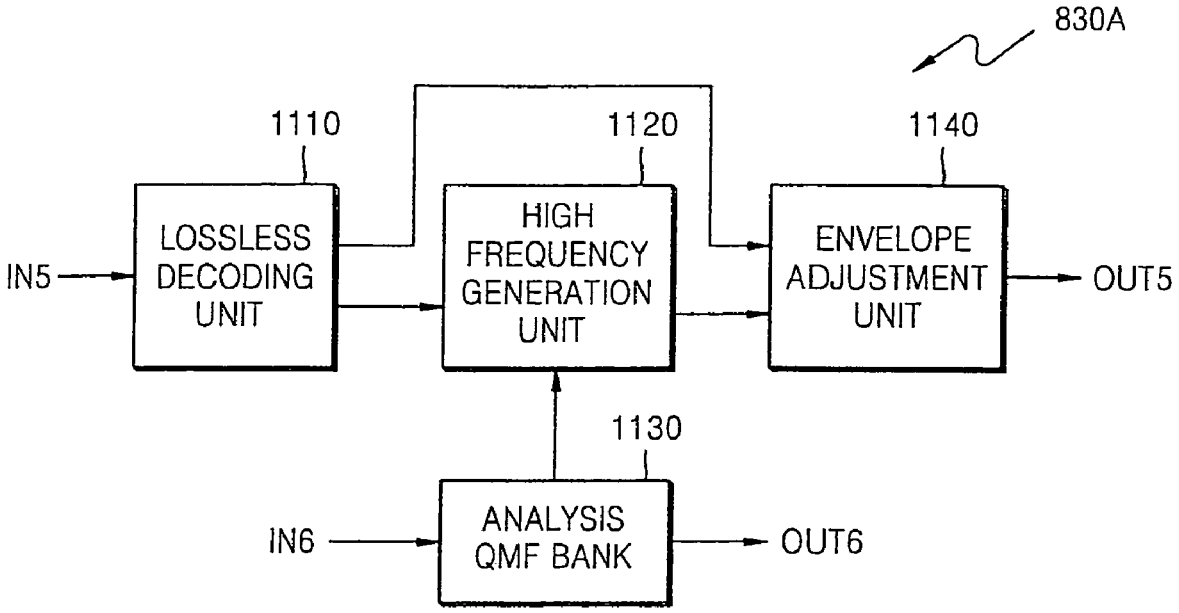
FIG. 11 is a block diagram of a SBR decoding unit 830A, which is an embodiment of a SBR decoding unit 830 shown in FIG. 8.

FIG. 11 is a block diagram of a SBR decoding unit 830A, which is an embodiment of the SBR decoding unit 830 shown in FIG. 8. The SBR decoding unit 830A includes a lossless decoding unit 1110, a high frequency generation unit 1120, an analysis QMF bank 1130, and an envelope adjustment unit 1140.

The lossless decoding unit 1110 receives 'the extracted SBR data' via an input port IN5 and performs lossless decoding on the received SBR data. Herein, the lossless decoding is entropy decoding or Huffman decoding. Hence, the lossless decoding unit 1110 obtains information with respect to the audio data in the frequency band between the first and second frequencies from the extracted SBR data. For example, the lossless decoding unit 1110 obtains information with respect to the envelope of the audio data in the frequency band between the first and second frequencies.

The high frequency generation unit 1120 causes the decoded audio data 920 to be generated in frequency bands (in FIG. 9, $f_3$-$f_6$, $f_6$-$f_9$, and $f_9$-$f_{10}$) that are equal to or greater than the maximum frequency $f_3$ (see FIG. 9) of the audio data 920. To achieve the generation of the audio data 920 in the frequency bands, since the decoded audio data 920 is audio data in the time domain, the high frequency generation unit 1120 may convert the encoded audio data into audio data in the frequency domain. To achieve this conversion, the SBR decoding unit 830 may include the analysis QMF bank 1130 as the SBR decoding unit 830A does.

The analysis QMF bank 1130 converts 'the decoded audio data' received via an input port IN6 into audio data in the frequency domain and outputs the audio data in the frequency domain via an output port OUT6.

The envelope adjustment unit 1140 adjusts the envelope of the audio data generated by the high frequency generation unit 1120, using the information obtained by the lossless decoding unit 1110. That is, the envelope adjustment unit 1140 adjusts the audio data generated by the high frequency generation unit 1120 so that the envelope of the audio data is identical to that of the audio data encoded by the scalable encoding unit 110. The adjusted audio data is output via an output port OUT5. The audio data input to the scalable encoding unit 110, which exists in the frequency band between the first and second frequencies, is inferred and is referred to as the adjusted audio data.

Figure 12:
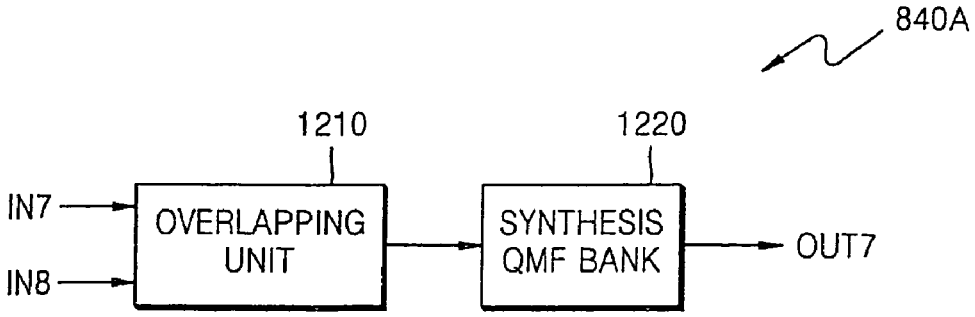
FIG. 12 is a block diagram of a data synthesis unit 840A, which is an embodiment of a data synthesis unit 840 shown in FIG. 8.

FIG. 12 is a block diagram of a data synthesis unit 840A, which is an embodiment of the data synthesis unit 840 shown in FIG. 8. The data synthesis unit 840A includes an overlapping unit 1210 and a synthesis QMF bank 1220.

The overlapping unit 1210 receives 'the audio data 920 decoded by the scalable decoding unit 820' via an input port IN7 and 'the audio data 930 inferred by the SBR decoding unit 830' via an input port IN8 and generates synthetic data using the decoded audio data 920 and the inferred audio data 930.

More specifically, the overlapping unit 1210 outputs the decoded audio data 920 as the synthetic data for the frequency band (i.e., from 0 to $f_3$ kHz in FIG. 9) where the decoded audio data 920 exists. The overlapping unit 1210 outputs the inferred audio data 930 as the synthetic data for the frequency band (see from $f_3$ to $f_{10}$ kHz in FIG. 9) where only the inferred audio data 930 exists.

The decoded audio data 920 received via the input port IN7 and the inferred audio data 930 received via the input port IN8 are both audio data in the frequency domain. Accordingly, if the decoded audio data is audio data in the time domain, it is desirably input to the input port IN7 via the analysis QMF bank 1130.

The synthesis QMF bank 1220 converts the synthetic data in the frequency domain into synthetic data in the time domain and outputs the synthetic data in the time domain via an output port OUT7.

Figure 13:
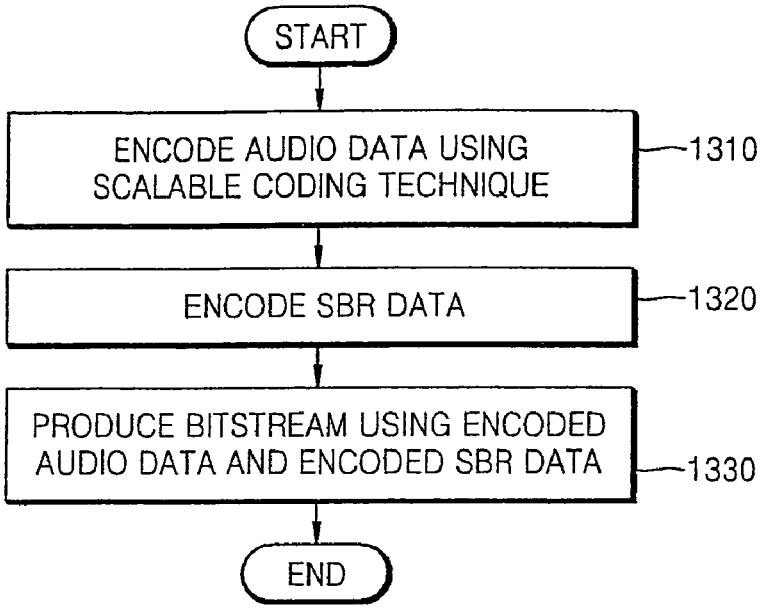
FIG. 13 is a flowchart illustrating an audio-data encoding method according to an embodiment of the present invention.

FIG. 13 is a flowchart illustrating an audio-data encoding method according to an embodiment of the present invention performed by the audio-data encoding apparatus of FIG. 1. The audio-data encoding method includes encoding audio data using the BASC technique 1310, encoding SBR data 1320, and generating a bitstream using the encoded audio data and the encoded SBR data 1330.

In operation 1310, the scalable encoding unit 110 divides the received audio data into a plurality of layers, represents the layers of the audio data in predetermined numbers of bits, and encodes the lower layers prior to encoding the upper layers and the upper bits of each layer prior to encoding the lower bits thereof.

In operation 1320, the SBR encoding unit 120 generates SBR data having the information with respect to the audio data in the frequency band ranging from the first frequency to the second frequency and performs Huffman coding on the SBR data.

Figure 20:
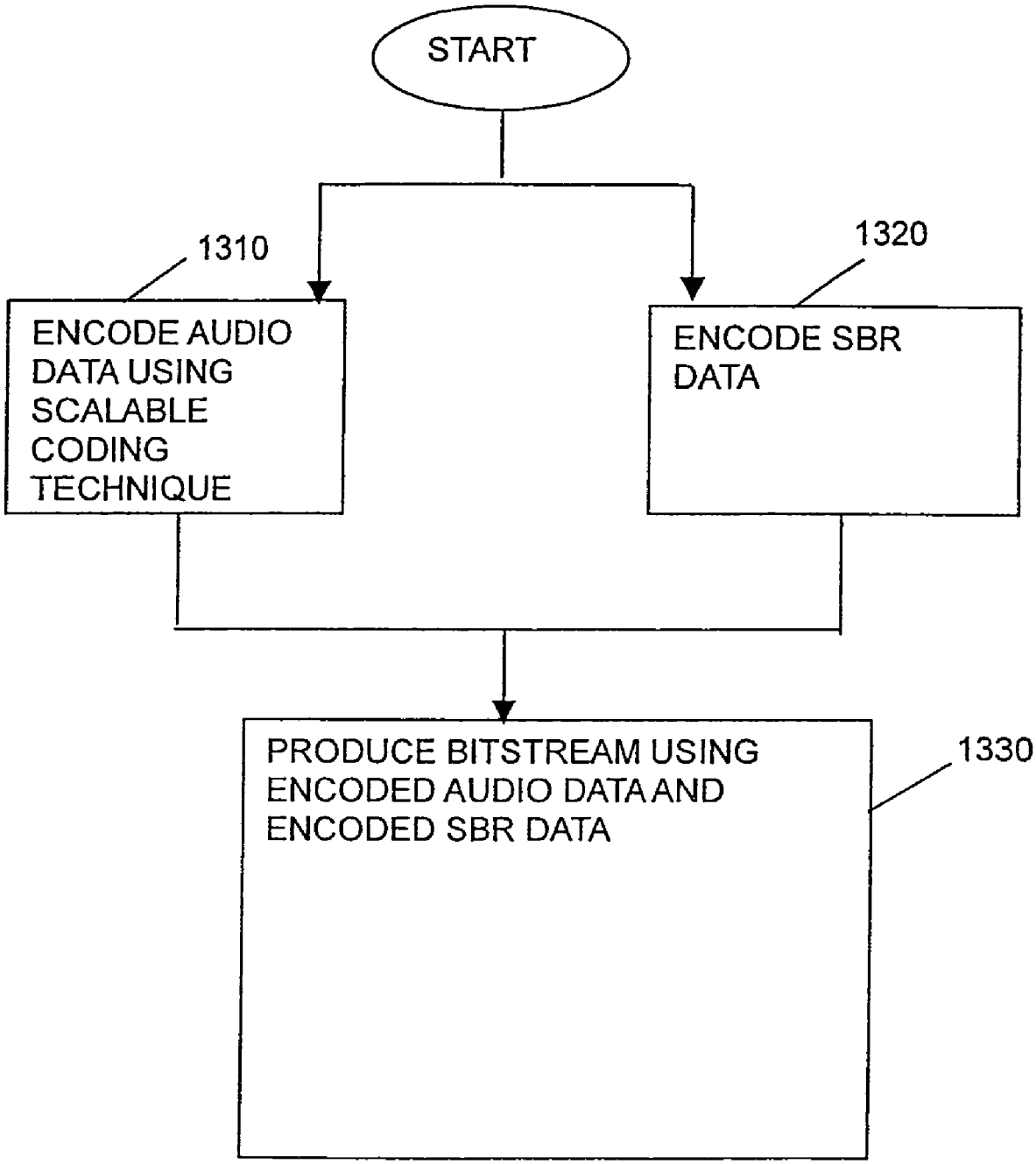
FIG. 20 is a flowchart illustrating an audio-data encoding method according to another embodiment of the present invention.
Figure 21:
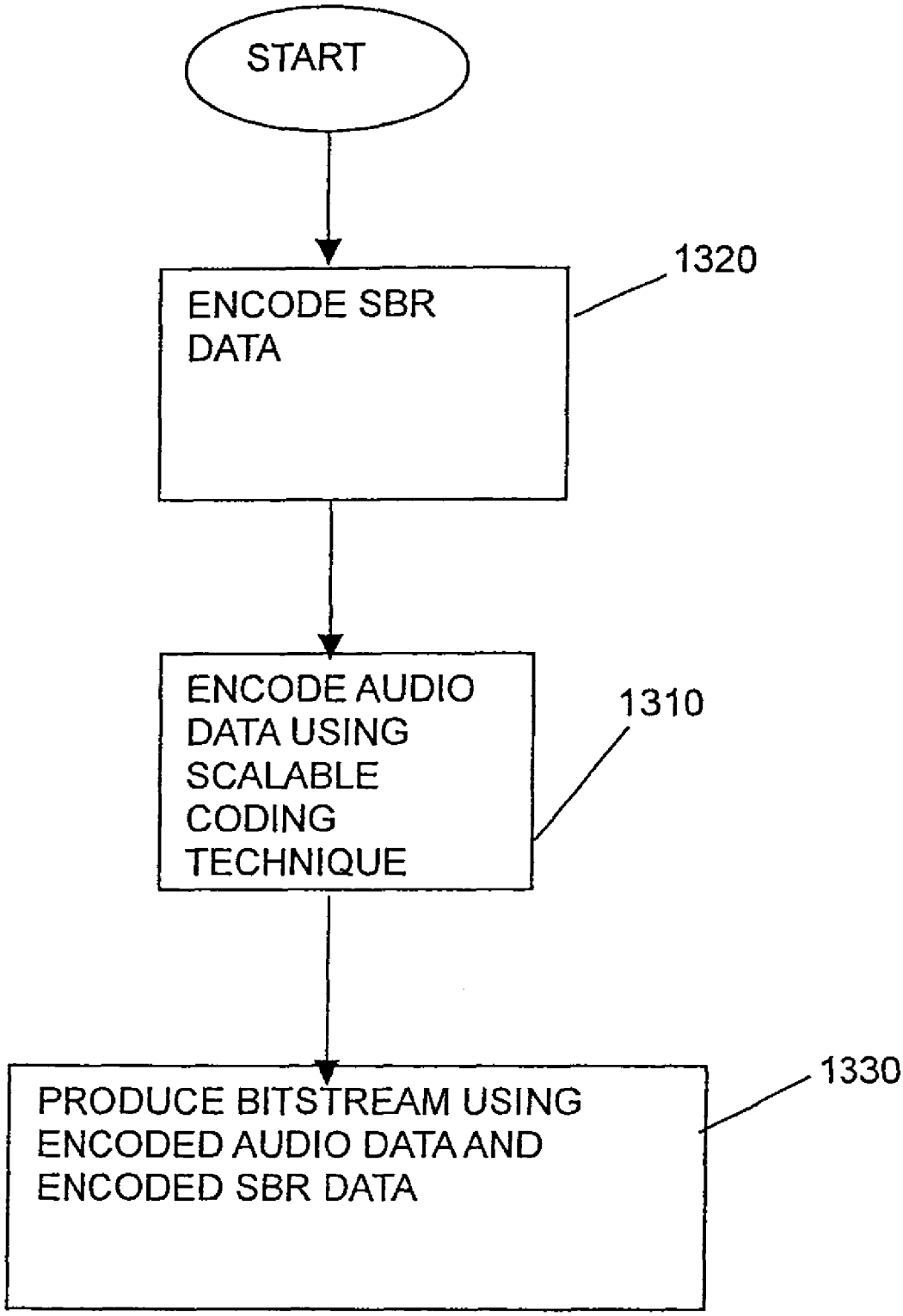
FIG. 21 is a flowchart illustrating an audio-data encoding method according to yet another embodiment of the present invention.

The operation 1320 may be performed after the operation 1310 as shown in FIG. 13. Alternatively, in contrast with FIG. 13, the operation 1320 may be performed before (see FIG. 20) or at the same time (see FIG. 21) as the operation 1310.

After operations 1310 and 1320, in operation 1330, the bitstream production unit 130 generates a bitstream using the audio data encoded in operation 1310 and the SBR data encoded in operation 1320.

Figure 14:
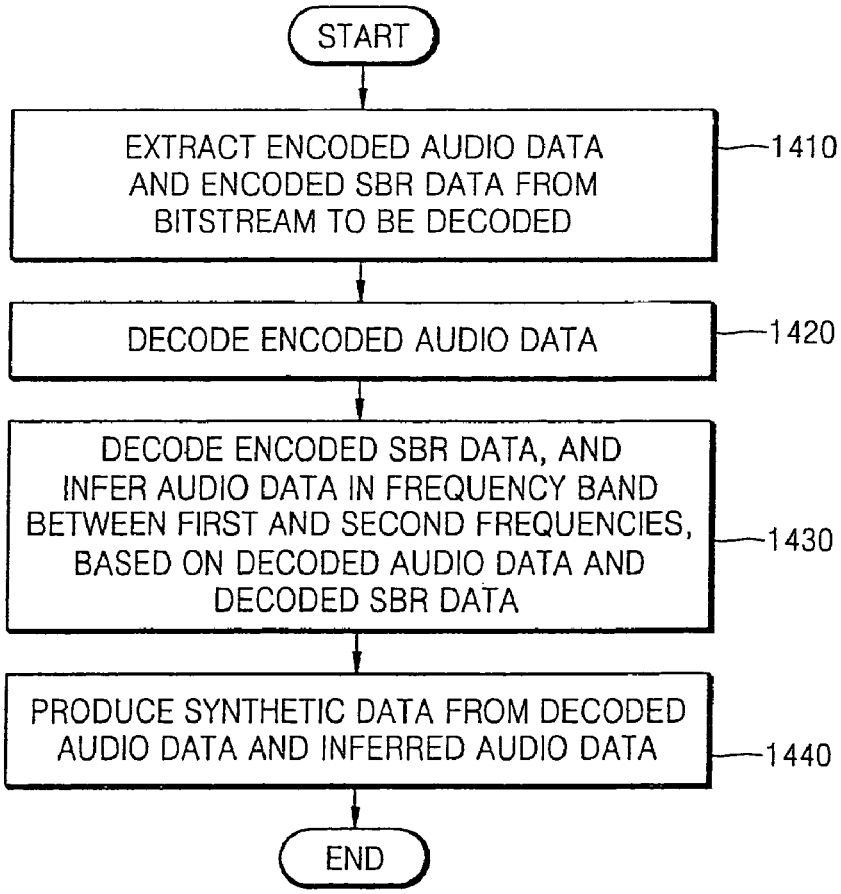
FIG. 14 is a flowchart illustrating an audio-data decoding method according to an embodiment of the present invention.

FIG. 14 is a flowchart illustrating an audio-data decoding method according to an embodiment of the present invention performed by the audio-data decoding apparatus of FIG. 8. The audio-data decoding method includes operations 1410 through 1440 of decoding the audio data included in a to-be-decoded bitstream to recover the audio data in the same frequency band as the frequency band of the audio data included in the bitstream and decoding the SBR data included in the bitstream, which is identical regardless of a content of the layers of the audio data included in the bitstream, to recover audio data in a frequency band of frequencies equal to or greater than a maximum frequency of the audio data included in the bitstream.

In operation 1410, the bitstream analysis unit 810 extracts the audio data encoded in operation 1310 and the SBR data encoded in operation 1320 from the bitstream to be decoded.

In operation 1420, the scalable decoding unit 820 decodes the audio data encoded in operation 1310 by decoding lower layers prior to decoding upper layers and the upper bits of each layer prior to decoding the lower bits thereof.

In operation 1430, the SBR decoding unit 830 decodes the SBR data encoded in operation 1320, and infers the audio data in the frequency band between the first and second frequencies, based on the audio data decoded in operation 1420 and the decoded SBR data.

In operation 1440, the data synthesis unit 840 generates synthetic data from the audio data decoded in operation 1420 and the audio data inferred in operation 1430 and determines the synthetic data as the audio data in the frequency band between 0 and the second frequency.

Figure 15:
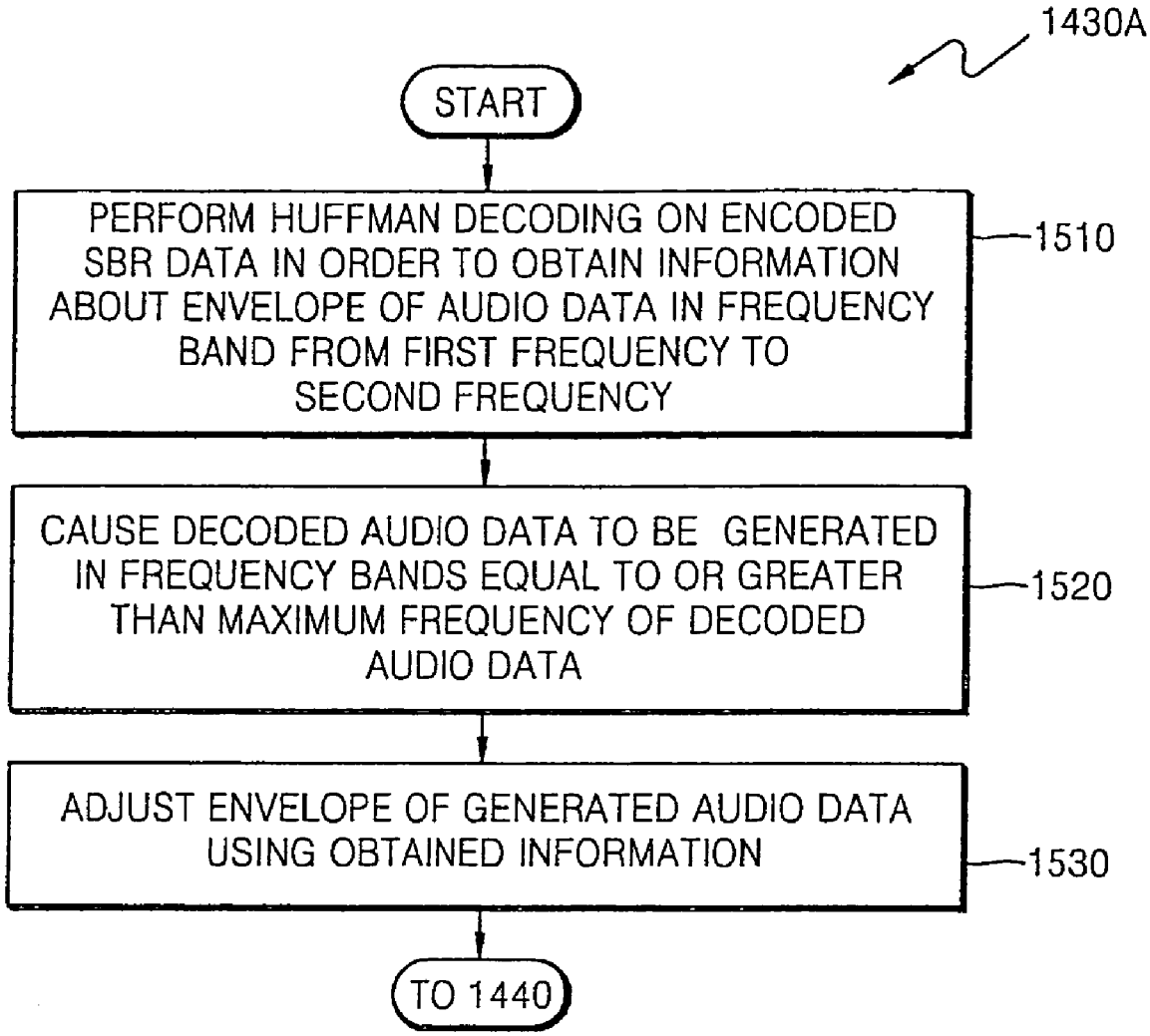
FIG. 15 is a flowchart illustrating an operation 1430A, which is an embodiment of an operation 1430 shown in FIG. 14.

FIG. 15 is a flowchart illustrating operation 1430A, which is an embodiment of the operation 1430. The operation 1430A includes operations 1510 through 1530 of inferring the audio data in the frequency band between the first and second frequencies based on the audio data decoded in operation 1420 and the SBR data encoded in operation 1320.

In operation 1510, the lossless decoding unit 1110 performs lossless decoding on the encoded SBR data included in the to-be-decoded bitstream in order to obtain information with respect to the envelope of the audio data in the frequency band from the first frequency to the second frequency.

In operation 1520, the high frequency generation unit 1120 causes the audio data decoded in operation 1420 to be generated in the frequency bands equal to or greater than the maximum frequency of the decoded audio data.

In operation 1530, the envelope adjustment unit 1140 adjusts the envelope of the audio data generated in operation 1520 using the information obtained in operation 1510. The operation 1530 is followed by operation 1440.

As described above, in an apparatus and method of encoding audio data and an apparatus and method of decoding encoded audio data according to the present invention, the audio data included in a to-be-decoded bitstream is decoded to recover the audio data in the same frequency band as the frequency band of the audio data included in the bitstream, and the SBR data included in the bitstream is decoded to recover audio data in a frequency band of frequencies equal to or greater than the maximum frequency of the audio data included in the bitstream. Hence, even when the audio data included in the bitstream is the encoded audio data of certain of the layers, the audio data of all the layers is recovered. Furthermore, the SBR data included in the bitstream is fixed, regardless of a content of the layers of the audio data included in the bitstream, so that the BSAC and SBR techniques may be easily combined together.

Embodiments of the invention may also be embodied as computer readable codes on a computer readable recording medium. The computer readable recording medium is any data storage device that stores data which may be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium may also be distributed over network coupled computer systems so that the computer readable code is stored and executed in a distributed fashion.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An audio data decoding method comprising:

decoding audio data, which is hierarchically encoded using bit-sliced arithmetic coding (BSAC);

detecting a code, which indicates that a payload of extended data has been started;

detecting a type of the extended data;

determining whether the detected type of the extended data indicates spectral band replication (SBR) data; and decoding the SBR data, when it is determined that the detected type indicates the SBR data.

2. The audio data decoding method of claim 1, wherein the code, which indicates that a payload of extended data has been started, is represented as 'zero code' and the type of the extended data is represented as 'extension type'.

* * * * *